US009774072B2

(12) United States Patent
Chung et al.

(10) Patent No.: US 9,774,072 B2
(45) Date of Patent: Sep. 26, 2017

(54) HOUSING, HANDHELD DEVICE, AND MANUFACTURING METHOD OF HOUSING

(71) Applicant: HTC Corporation, Taoyuan County (TW)

(72) Inventors: Cheng-Han Chung, Taoyuan County (TW); Chih-Kuang Wang, Taoyuan County (TW); Yen-Liang Kuo, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 287 days.

(21) Appl. No.: 14/154,199

(22) Filed: Jan. 14, 2014

(65) Prior Publication Data

US 2014/0191910 A1 Jul. 10, 2014

Related U.S. Application Data

(63) Continuation-in-part of application No. 12/768,736, filed on Apr. 28, 2010, now Pat. No. 8,665,159.

(30) Foreign Application Priority Data

Oct. 9, 2009 (TW) ..... 98134312 A

(51) Int. Cl.
*H01Q 1/24* (2006.01)
*H01Q 1/40* (2006.01)
*H01Q 1/44* (2006.01)

(52) U.S. Cl.
CPC ..... *H01Q 1/243* (2013.01); *H01Q 1/40* (2013.01); *H01Q 1/44* (2013.01); *Y10T 29/49016* (2015.01)

(58) Field of Classification Search
CPC ..... H01Q 1/243; H01Q 1/40; H01Q 1/44
(Continued)

(56) References Cited

U.S. PATENT DOCUMENTS 6,362,786 B1 * 3/2002 Asano ..... G06F 1/1616 343/700 MS
6,531,985 B1 * 3/2003 Jones ..... G06F 1/1616 343/700 MS (Continued)

FOREIGN PATENT DOCUMENTS

CN 101075699 11/2007
CN 101138131 3/2008

(Continued)

OTHER PUBLICATIONS

"Office Action of Related U.S. Appl. No. 13/672,464", dated May 5, 2015, p. 1-p. 30.

(Continued)

*Primary Examiner* — Khai M Nguyen
(74) *Attorney, Agent, or Firm* — Jianq Chyun IP Office

(57) ABSTRACT

A housing, a handheld device and a manufacturing method of a housing are provided. The housing includes a body, a metal antenna layer, and a conductive element. The body includes a through hole and an outer surface and an inner surface opposite to the outer surface. The metal antenna layer is disposed on the outer surface and covers the through hole, wherein an edge of the metal antenna layer is connected to the outer surface seamlessly, and a surface of the metal antenna layer is at least partially exposed by the body. The conductive element is disposed in the through hole and directly contacts the metal antenna layer to transmit signals received by the metal antenna layer.

18 Claims, 6 Drawing Sheets

(58) Field of Classification Search
USPC ..... 343/702
See application file for complete search history.

(56) References Cited

U.S. PATENT DOCUMENTS

| | | | | |
|---|---|---|---|---|
| 6,670,926 | B2 * | 12/2003 | Miyasaka | G06F 1/1616 343/702 |
| 8,812,062 | B2 * | 8/2014 | Hata | H01Q 1/22 455/269 |
| 2002/0145567 | A1 | 10/2002 | Spiegel et al. | |
| 2006/0089184 | A1 | 4/2006 | Kim et al. | |
| 2008/0316116 | A1 | 12/2008 | Hobson et al. | |
| 2009/0153411 | A1 | 6/2009 | Chiang et al. | |
| 2010/0134357 | A1 | 6/2010 | Yang et al. | |
| 2012/0009884 | A1 | 1/2012 | Rao et al. | |
| 2012/0009983 | A1 | 1/2012 | Mow et al. | |
| 2012/0268343 | A1 | 10/2012 | Yanagi et al. | |
| 2013/0141885 | A1 | 6/2013 | Gu et al. | |
| 2013/0257659 | A1 | 10/2013 | Darnell et al. | |
| 2014/0015724 | A1 | 1/2014 | Bungo | |

FOREIGN PATENT DOCUMENTS

| | | |
|---|---|---|
| CN | 101366147 | 2/2009 |
| CN | 101641826 | 2/2010 |
| CN | 102683833 | 9/2012 |
| CN | 202587659 | 12/2012 |
| EP | 1294051 | 3/2003 |
| FR | 2837036 | 9/2003 |
| FR | 2889360 | 2/2007 |
| JP | 2004172764 | 6/2004 |
| JP | 2004215132 | 7/2004 |
| TW | I260817 | 8/2006 |
| WO | 2007129410 | 11/2007 |

OTHER PUBLICATIONS

"Office Action of China Counterpart Application", dated Dec. 5, 2012, p. 1-p. 6.
"European Search Report of Europe Counterpart Application", dated Jul. 23, 2010, p. 1-p. 3.
"First Office Action of Europe Counterpart Application", dated Jul. 28, 2010, p. 1-p. 4.
"Office Action of China Related Application" , application No. 201310032515.5, dated Aug. 5, 2015, p. 1-p. 7.
"Office Action of Taiwan Counterpart Application", dated Jan. 19, 2016, p. 1-p. 5.
"Office Action of China Counterpart Application," dated Feb. 24, 2017, p. 1-p. 8.

* cited by examiner

HOUSING, HANDHELD DEVICE, AND MANUFACTURING METHOD OF HOUSING

CROSS-REFERENCE TO RELATED APPLICATION

This application is a continuation-in-part application of and claims the priority benefit of U.S. application Ser. No. 12/768,736, filed on Apr. 28, 2010, now allowed, which claims the priority benefit of Taiwan application serial no. 98134312, filed on Oct. 9, 2009. The entirety of each of the above-mentioned patent applications is hereby incorporated by reference herein and made a part of this specification.

FIELD OF THE DISCLOSURE

The disclosure relates to a housing, a handheld device and a manufacturing method of a housing. More specifically, the disclosure relates to a housing in which the antenna layer is seamlessly connected to the outer surface and a manufacturing method thereof and a handheld device having the housing.

DESCRIPTION OF RELATED ART

Currently, communication methods of the public are gradually changed to wireless communications, and wireless communication devices become more diversified, for example, smart phones, multimedia players, personal digital assistants (PDA), satellite navigation devices and so on. The electronic devices having wireless transmission function are improved by a trend that design concept which is developed to be lighter and slimmer, in order to be more popular, more convenient and broadly used in our daily life. It is worth to be mentioned that the antenna is an essential component to various wireless communication systems, and moreover is the main component which concerns with the whole performance of the system.

Taking the mobile phone as an example, in order to reduce the volume of the mobile phone, the antenna of a conventional mobile phone may be disposed within the housing or cover. Thus, the antenna is easy to be affected by other metal components of the mobile phone, such as speaker, battery, connector, or the like.

SUMMARY OF THE DISCLOSURE

The disclosure provides a housing, wherein the antenna is seamlessly connected on the outer surface thereof, and the whole aesthetic sensation of the appearance is further enhanced.

The disclosure provides a handheld device employing the housing, which not only enhances the whole aesthetic sensation of the appearance, the signal receiving quality of the antenna is also improved.

The disclosure provides a manufacturing method of a housing, which simplifies the complicated fabrication process and reduces the manufacturing cost.

The housing of the disclosure includes a body, a metal antenna layer and a conductive element. The body includes a through hole and an outer surface and an inner surface opposite to the outer surface. The metal antenna layer is disposed on the outer surface and covers the through hole, wherein an edge of the metal antenna layer is connected to the outer surface seamlessly, and a surface of the metal antenna layer is at least partially exposed by the body. The conductive element is disposed in the through hole and directly contacts the metal antenna layer to transmit signals received by the metal antenna layer.

In the disclosure, the handheld device includes a host and the abovementioned housing. The housing encases the host.

The manufacturing method of a housing of the disclosure includes the following steps. First, a body is provided, wherein the body includes a through hole and an outer surface and an inner surface opposite to the outer surface. Next, a metal antenna layer is electroplated to form on the outer surface of the body, wherein the metal antenna layer covers the through hole, an edge of the metal antenna layer is connected to the outer surface seamlessly, and a surface of the metal antenna layer is at least partially exposed by the body. After that, a conductive element is disposed in the through hole and directly contacts the metal antenna layer, wherein the conductive element is adapted to transmit signals received by the metal antenna layer.

In light of the above, in the disclosure, the metal antenna layer is fabricated on the outer surface of the housing. The antenna which is exposed on the outer surface is seamlessly connected on the outer surface of the body, and thus the whole aesthetic sensation of the appearance of the housing is further enhanced.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EXEMPLARY EMBODIMENTS

FIG. 1A to FIG. 1D are schematic views illustrating a manufacturing method of a housing according to an embodiment of the disclosure. FIG. 2 is a schematic cross-sectional view taken along a line I-I in FIG. 1A. It has to be mentioned that a housing (e.g., back cover, casing) of a smart phone is taken as an example in the embodiment, and the disclosure is not limited thereto. Specifically, the housing of the disclosure may be used in the application of other electronic devices, such as tablet computers, notebook computer, and the like.

Figure 1A:
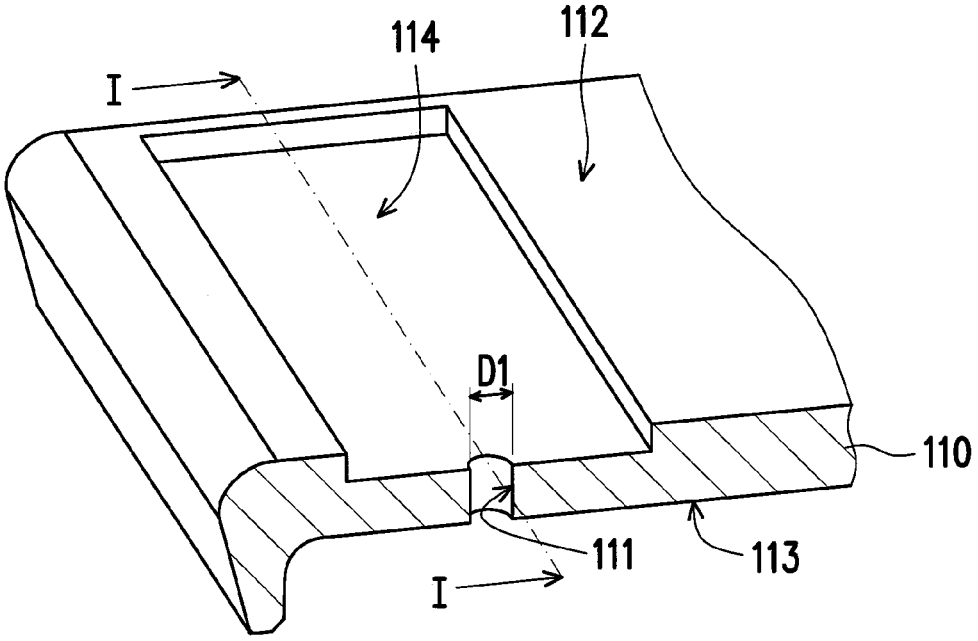
FIG. 1A to FIG. 1D are schematic views illustrating a manufacturing method of a housing according to an embodiment of the disclosure.
Figure 2:
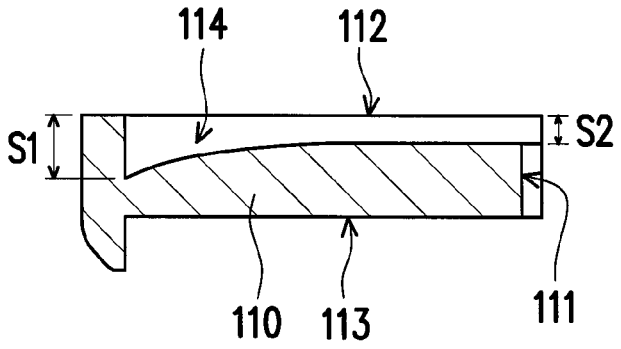
FIG. 2 is a schematic cross-sectional view taken along a line I-I in FIG. 1A.

Referring to FIG. 1A, the manufacturing method of the housing of the disclosure is that first the body 110 is provided, wherein the body 110 includes a through hole 111, an outer surface 112 and an inner surface 113 opposite to the outer surface 112, and the through hole 111 extends from the outer surface 112 to the inner surface 113. The body 110 may be composed of a material such as metal, plastic, or the like. The through hole 111 is formed on the body 110 by micro drilling process, for example. And, the diameter D1 of the through hole 111 at the outer surface 112 is from 0.05 mm to 0.5 mm, for example.

On the other hand, in the embodiment, the body 110 further has a recess region 114 which is located at the outer 112, and the through hole 111 is formed in the recess region 114, for example. As shown in FIG. 2, a depth S1 of a periphery of the recess region 114 is greater than a depth S2 of a center of the recess region 114. In the embodiment, the through hole 111 is located at the center of the recess region 114, however the disclosure is not limited thereto.

Figure 1B:
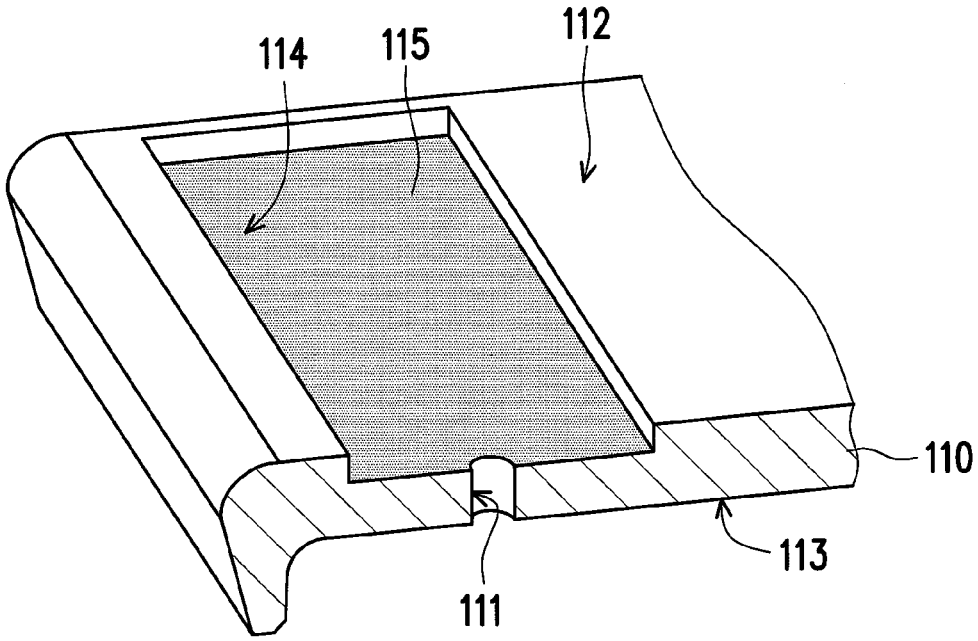
Figure 1C:
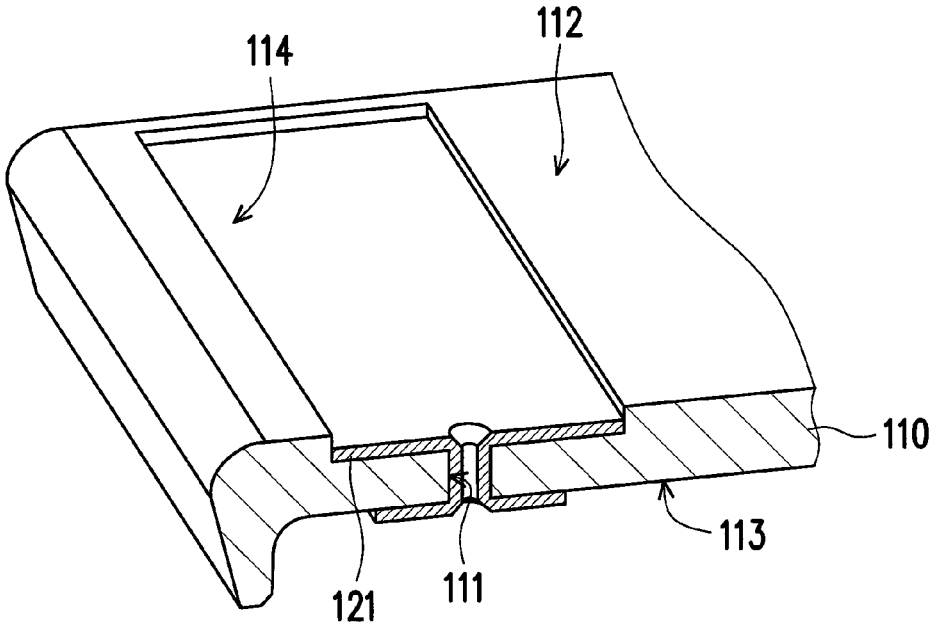
Figure 1D:
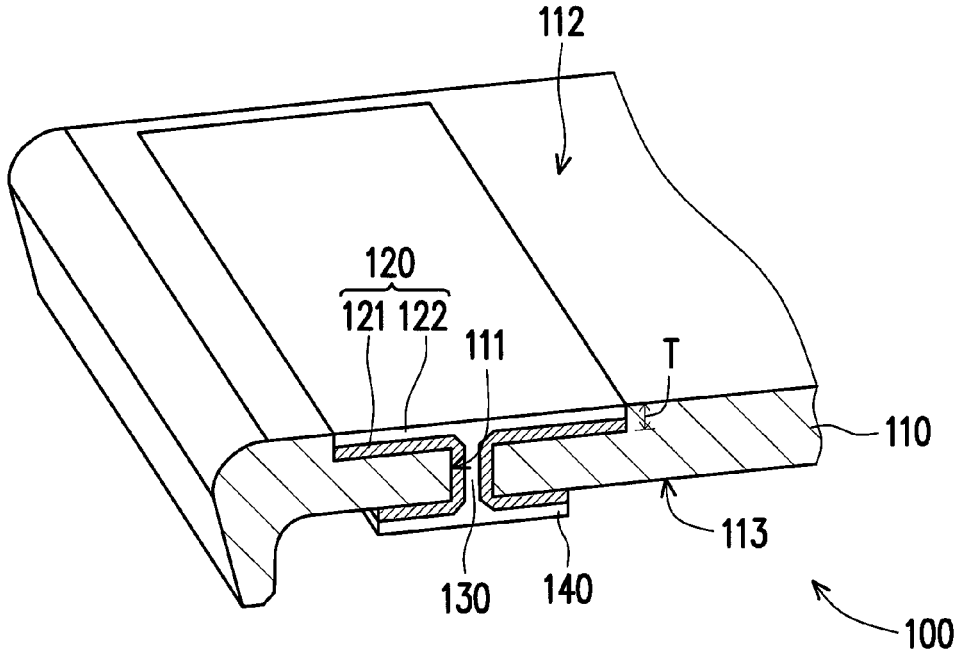

Next, a metal antenna layer 120 is electroplated and formed in the recess region 114 which is on the outer surface 112 of the body 120, as shown in FIG. 1D. The metal antenna layer 120 covers the through hole 111, wherein the edge of the metal antenna layer 120 is connected to the outer surface 112 seamlessly, and the surface of the metal antenna layer 120 is at least partially exposed by the body 110.

Specifically, the manufacturing method of the metal antenna layer 120 by electroplating includes the following steps. First, as shown in FIG. 1B, a part of the outer surface 112 of the body 110 is activated, so as to form an activated region 115, and the distributed area of the activated region 115 is approximately equal to that of the recess region 114. Then, as shown in FIG. 1C, a plating seed layer 121 is formed in the activated region 115 by using an electroless plating process, and the plating seed layer 121 may further be formed at the side wall of the through hole 111, and continuously formed at a partial region of the inner surface 113 of the body 110. Herein the plating seed layer 121 consists of conductive materials such as tin, silver, copper, chromium, nickel, or an alloy thereof, and the plating seed layer 121 may be formed by Physical Vapor Deposition (PVD) process or Chemical Vapor Deposition (CVD) process, and the disclosure is not limited thereto. In addition, if the body 110 is a metal material, places where electroplating is not needed are required to spray paint in order to insulate from being reacted to electroplating process.

After that, referring to FIG. 1D, the plating metal layer 122 is electroplated and formed on the plating seed layer 121. Specifically, the plating metal layer 122 is also formed on the plating seed layer 121 which is within the through hole 111, and continuously formed on the plating seed layer 121 which is on the inner surface 113 of the body 110. Herein the plating metal layer 122 may consist of the same material as the plating seed layer 121 or any other appropriate conductive material. Herein the manufacturing of the metal antenna layer 120 is substantially completed, in other words, the metal antenna layer 120 includes the plating seed layer 121 and the plating metal layer 122, and the thickness T is from 20 μm to 200 μm. Additionally, the through hole 111 is filled up with the plating seed layer 121 and the plating metal layer 122, and covered by the metal antenna layer 120 which is located on the outer surface 112 and the inner surface 113 opposite to the outer surface 112 of the body 110.

Figure 3A:
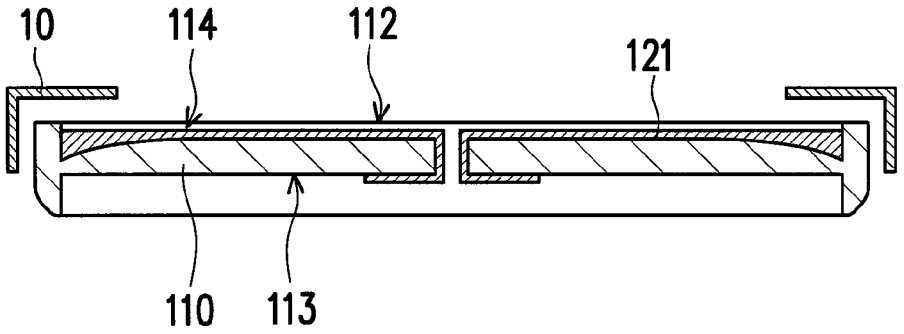
FIG. 3A and FIG. 3B are schematic views illustrating a manufacturing method of the plating metal layer as depicted in FIG. 1D.
Figure 3B:
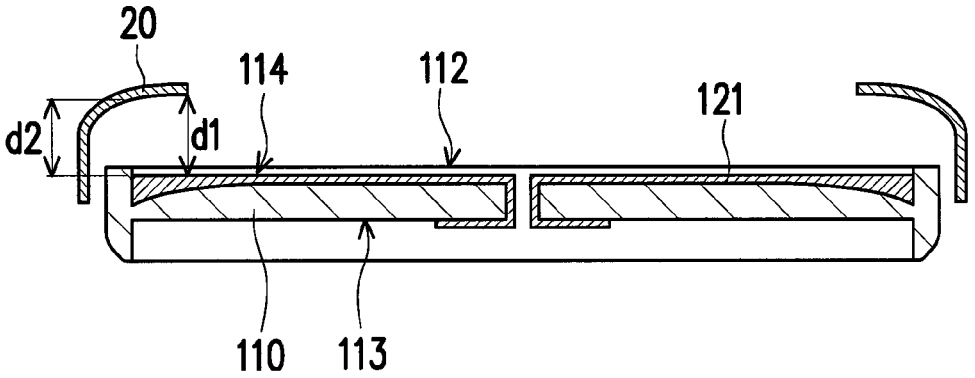

FIG. 3A and FIG. 3B are schematic views illustrating a manufacturing method of the plating metal layer as depicted in FIG. 1D. As shown in FIG. 3A, when the plating metal layer 122 is electroplated and formed, for example, a mask 10 is disposed above the plating seed layer 121 to shield the edge of the plating seed layer 121, and at this time, the mask 10 and the surface to be electroplated (i.e., the surface of the plating seed layer 121) maintain a distance. Through this, during the electroplating process, the mask 10 may affect the flow of the electroplating solution (not shown) within the recess region 114. Generally speaking, the flow of the electroplating solution within the recess region 114 nearby the mask 10 is inferior to the flow of the electroplating solution within the recess region 114 which is not shielded by the mask 10, therefore the reaction efficiencies of the electroplating solution from the two regions forming the plating metal layer 122 are different, wherein the reaction efficiency of the electroplating solution within the recess region 114 nearby the mask 10 is lower than that of the electroplating solution within the recess region 114 which is not shielded by the mask 10. Based on this, the plating metal layer 122 having a smaller thickness may be formed at the periphery (i.e., the place shielded by the mask 10) of the recess region 114, and the plating metal layer 122 having a larger thickness may be formed at the recess region 114 which is not shielded by the mask 10.

On the other hand, in practice, after electroplated, the thickness of the plating metal layer 122 of the periphery of the recess region 114 may be smaller than the thickness of the plating metal layer 122 of the center of the recess region 114. Therefore, as shown in FIG. 2, through the configuration that the depth S1 of the periphery of the recess region 114 is greater than the depth S2 of the center of the recess region 114, the whole smoothness of the resulted plating metal layer 122 may be increased, and the surface of the metal antenna layer 120 located at the through hole 110 is smooth and thus the whole aesthetic sensation of the appearance is further enhanced.

It has to be noted that, the mask 10 shown in FIG. 3A is merely an example for illustration, it is not a limitation of the disclosure. In other embodiments, when the plating metal layer 122 is electroplated and formed, by disposing a mask 20 shown in FIG. 3B above the plating seed layer 121 to shield the edge of the plating seed layer 121, the thickness of the plating seed layer 122 within the recess region 114 may be changed, and the function and principle are similar to the abovementioned embodiments and not repeated herein. What different than the mask 10 is that, the distance d1 between the mask 20 at the periphery of the plating seed layer 121 and the plating seed layer 121 is smaller than the distance d2 between the mask 20 away from the periphery of the plating seed layer 121 and the plating seed layer 121. Based on such configuration, the difference of the thickness of the plating metal layer 122 formed at the periphery (i.e., the place shielded by the mask 20) of the recess region 114 and the thickness of the plating metal layer 122 formed at the recess region 114 which is not shielded by the mask 20 may be more obvious.

After the abovementioned manufacturing process is completed, the manufacturing of the housing is substantially completed. In detailed, in the embodiment, the grounding pad 140 and the conductive element 130 are formed together when the metal antenna layer 120 is electroplated. Namely, the metal antenna layer 120, grounding pad 140 and the conductive element 130 may be formed integrally, wherein the conductive element 130 is the metal antenna layer 120 which is located within the through hole 111, and the grounding pad 140 is the metal antenna layer 120 which is located on the inner surface 113, for example.

In other words, the manufacturing processes like disposing the conductive element 130 in the through hole 111 and directly contacting the metal antenna layer 120, and disposing the grounding pad 140 in the inner surface 113 of the body 110 are completed as shown in FIG. 1D which illustrates the manufacturing process. The conductive element 130 is used for transmitting signals received by the metal antenna layer 120, and the grounding pad 140 covers the through hole 111 and directly contacts the conductive element 130. As such, the complicated manufacturing process is simplified and manufacturing cost is reduced, and the metal antenna layer 120 is seamlessly connected to the outer surface 112, thus the whole aesthetic sensation of the appearance of the housing 100 is further enhanced.

Figure 4A:
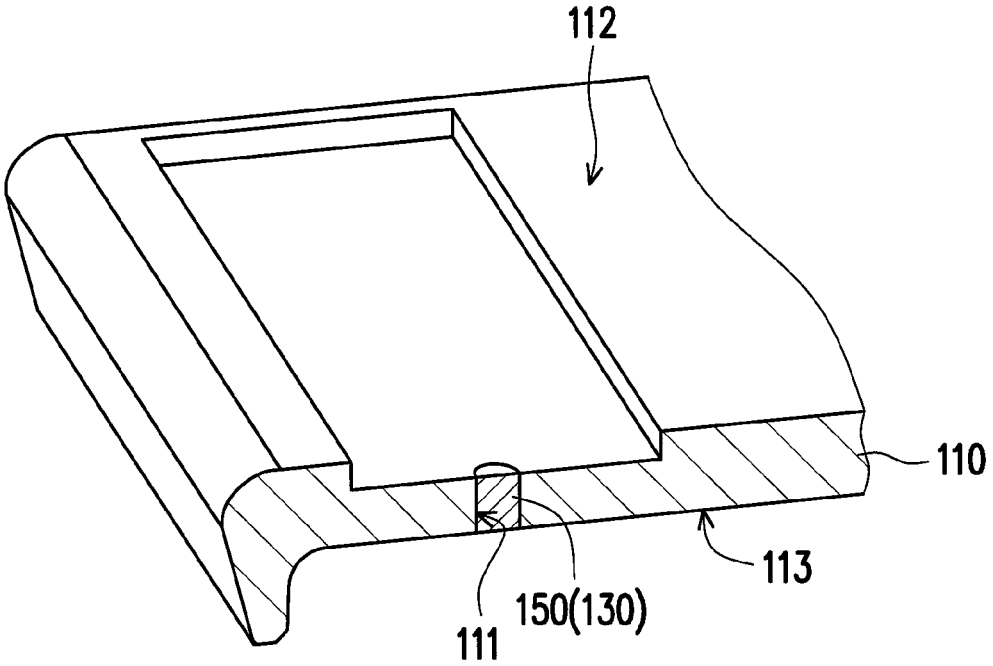
FIG. 4A and FIG. 4B are schematic views illustrating a disposing method of a conductive element according to another embodiment of the disclosure.
Figure 4B:
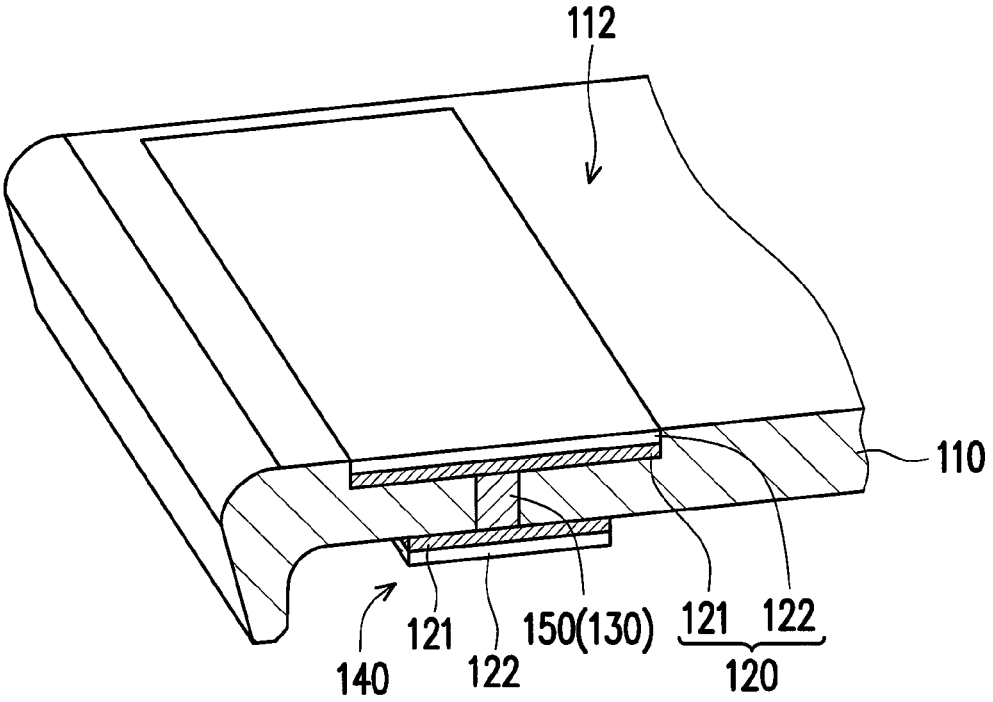

FIG. 4A and FIG. 4B are schematic views illustrating a disposing method of a conductive element according to another embodiment of the disclosure. In the abovementioned embodiments, the metal antenna layer 120, grounding pad 140 and the conductive element 130 are exemplarily illustrated to be formed integrally, and in other embodiments, the metal antenna layer 120, grounding pad 140 and the conductive element 130 may be formed separately. Referring to FIG. 4A, the conductive element 130 is formed by the conductive adhesive 150 after solidified which is filled into the through hole 111 of the body 110, or is formed together with the body 110 by an insert molding process.

Referring to FIG. 4B, after the conductive element 130 is formed, the metal antenna layer 120 is formed on the outer surface 112 of the body 110, and the grounding pad 140 is formed on the inner surface 113 of the body 110, wherein the grounding pad 140 and the metal antenna layer 120 also consist of the plating seed layer 121 and the plating metal layer 122, for example, and the manufacturing method is similar to the abovementioned embodiment, and it is not repeated thereto. Certainly, in other embodiments which are not shown in drawings, the grounding pad 140 may also be a structure which consists of other conductive material, and it is not limited thereto.

Figure 5A:
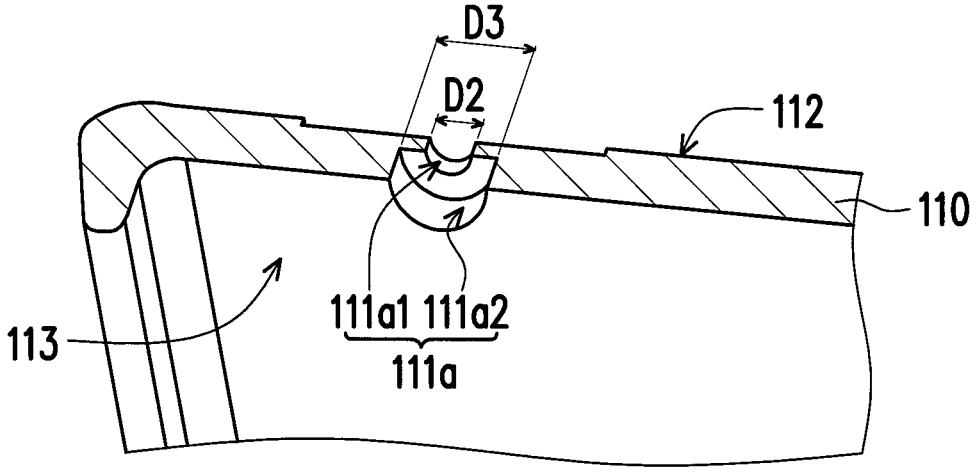
FIG. 5A and FIG. 5B are schematic views illustrating the through hole of FIG. 1A according to another embodiment of the disclosure.
Figure 5B:
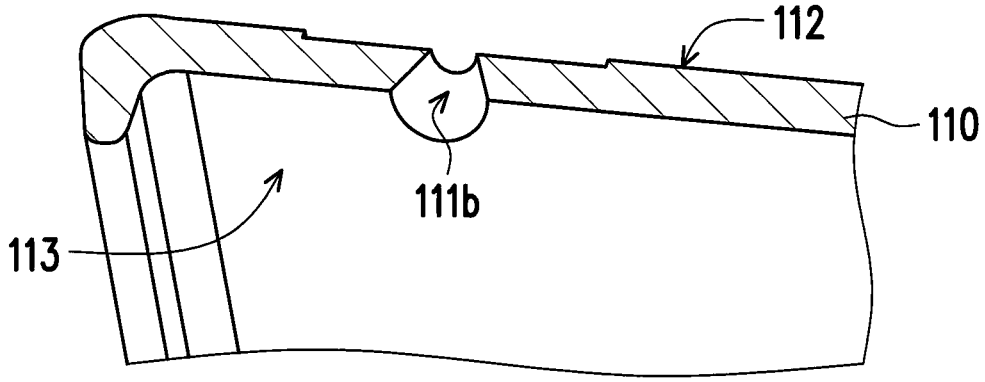

FIG. 5A and FIG. 5B are schematic views illustrating the through hole of FIG. 1A according to another embodiment of the disclosure. In the abovementioned embodiment, the through hole 111 formed on the body 110 is exemplarily illustrated as cylindrical pillar space, however the disclosure is not limited thereto. Referring to FIG. 5A, the diameter D2 of the through hole 111*a* at the outer surface 112 is smaller than the diameter D3 of the through hole 111*a* at the inner surface 113, and the diameter D2 may be from 0.05 mm to 0.5 mm. Further, the through hole 111*a* may consist of the first pillar space 111*a*1 and the second pillar space 111*a*2 which are different in dimensions, and for example cylindrical pillar spaces.

For the manufacturing method, the forming of the through hole 111*a* includes the following steps. First, drilling the body 110 from the inner surface 113 to obtain the first pillar space 111*a*1. Next, drilling the body 110 from the bottom surface of the first pillar space 111*a*1 to obtain the second pillar space 111*a*2, wherein the dimension of the first pillar space 111*a*1 is smaller than the dimension of the second pillar space 111*a*2. However, in other embodiments which are not shown in drawings, the steps and manufacturing orders for forming the through hole may be formed by other manufacturing methods, and it is not limited thereto.

Referring to FIG. 5B, the difference between the through hole 111*b* of FIG. 5B and the through hole 111*a* of FIG. 5A is that, the through hole 111*b* is a cone, for example, and the manufacturing method is that drilling the body 110 from the inner surface 113 of the body 110 to obtain the through hole 111*b*, for example. In other embodiments not shown in drawings, the through hole of the disclosure may also consist of other type of pillar space, other type of cone space, cone spaces with different dimensions, or a combination of pillar space and cone space, and the disclosure is not limited thereto.

Figure 6:
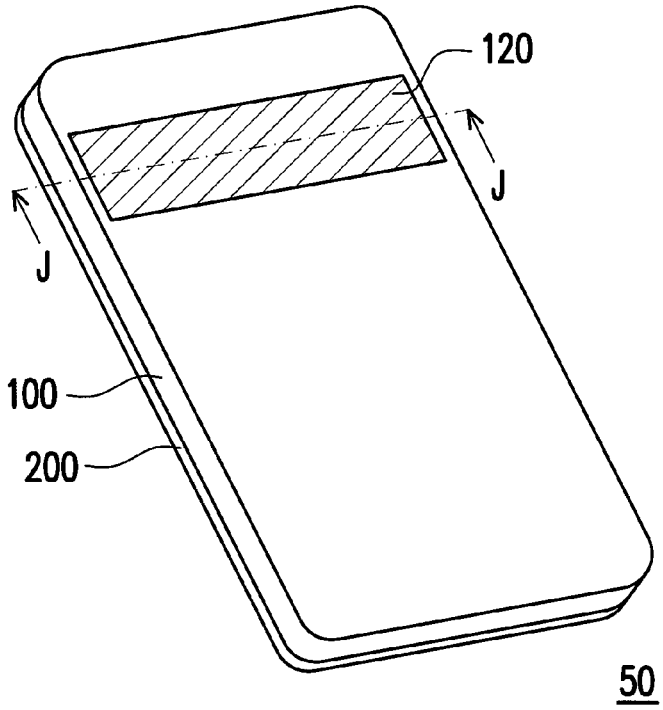
FIG. 6 is a schematic view illustrating a handheld device according to an embodiment of the disclosure.
Figure 7:
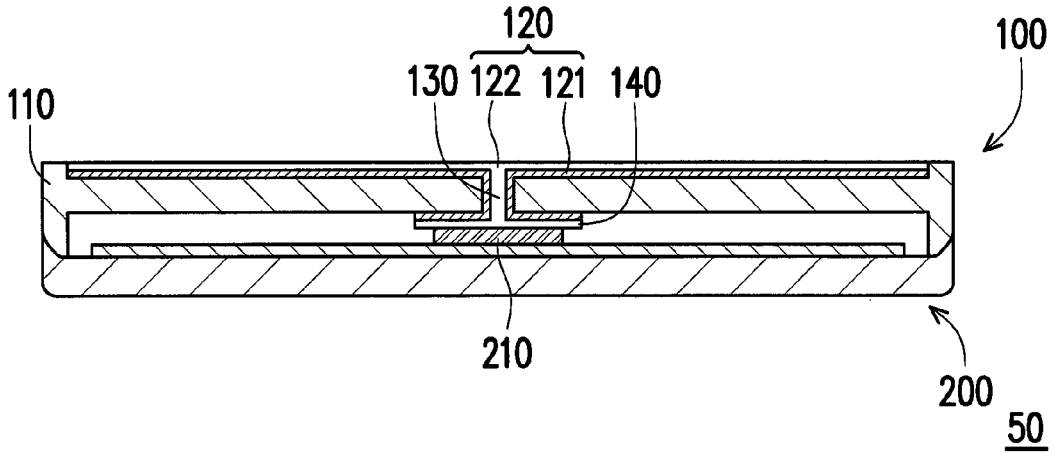
FIG. 7 is a schematic cross-sectional view taken along a line J-J in FIG. 6.

FIG. 6 is a schematic view illustrating a handheld device according to an embodiment of the disclosure. FIG. 7 is a schematic cross-sectional view taken along a line J-J in FIG. 6. With reference to FIG. 6 and FIG. 7, in the embodiment, the handheld device 50 includes the housing 100 described in the abovementioned embodiment and a host 200. The housing 100 and the host 200 is latched together so as to encase the internal components of the host 200, wherein the host has a connecting pad 210 corresponding to the grounding pad 140, and after the housing 100 and the host 200 is latched together, the grounding pad 140 is connected to the connecting pad 210, in order that the signals received by the metal antenna layer 120 may be transmitted sequentially through the conductive element 130, the grounding pad 140, and the connecting pad 210. Finally, the signals are transmitted to the processing unit (not shown) through the corresponding internal circuit (not shown) within the host 200.

In brief, the housing 100 which is employed by the handheld device 50 is designed as the antenna is seamlessly integrated thereon, wherein a part of the antenna is exposed by the outer surface 112, and accordingly the problems of the antenna being shielded by the metal component or signal interference may be resolved. Thus, not only the whole aesthetic sensation of the appearance of the handheld device 50 is enhanced, the signal receiving quality of the antenna is also improved.

In light of the foregoing, in the disclosure, the plating metal layer is fabricated on the outer surface of the housing, and the plating metal layer and the plating seed layer are designed to be the metal antenna layer. The metal antenna layer which is exposed on the outer surface is seamlessly connected to the body, and thus the whole aesthetic sensation of the appearance of the housing is further enhanced. On the other hand, the metal antenna layer, the conductive element and the grounding pad may be formed together when the metal antenna layer is formed. In other words, the metal antenna layer, the conductive element and the grounding pad may be formed integrally, and thus complicated manufacturing process is simplified and manufacturing cost is reduced. Therefore, the handheld devices such as smart phones, tablet computers, notebook computers, or the like, which employ the abovementioned housing as the back cover thereof may not only enhance the whole aesthetic sensation of the appearance, through the integrated design of the metal antenna layer and the housing, the signal receiving quality of the antenna may also be effectively improved.

Although the disclosure has been disclosed by the above embodiments, they are not intended to limit the disclosure. Anybody skilled in the art may make modifications and variations without departing from the spirit and scope of the disclosure. Therefore, the protection range of the disclosure falls within the appended claims.

What is claimed is:

1. A housing comprising:

a body, having a through hole, an outer surface and an inner surface opposite to the outer surface, wherein the through hole extends from the outer surface to the inner surface;

a metal antenna layer, disposed on the outer surface of the body and covering the through hole, wherein an edge of the metal antenna layer is connected to the outer surface, and a surface of the metal antenna layer is at least partially exposed by the body;

a conductive element, disposed in the through hole and directly contacting the metal antenna layer to transmit signals received by the metal antenna layer; and a grounding pad disposed on the inner surface of the body, covering the through hole and directly contacting with the conductive element.

2. The housing as claimed in claim 1, wherein a part of surface of the metal antenna layer where the through hole is located is smooth.

3. The housing as claimed in claim 1, wherein the body further has a recess region located on the outer surface, and the metal antenna layer is disposed in the recess region.

4. The housing as claimed in claim 3, wherein a depth of a periphery of the recess region is larger than a depth of a center of the recess region.

5. The housing as claimed in claim 1, wherein the metal antenna layer, the grounding pad and the conductive element are integrally formed.

6. The housing as claimed in claim 1, wherein a thickness of the metal antenna layer is from 20 μm to 200 μm.

7. The housing as claimed in claim 1, wherein a diameter of the through hole at the outer surface is smaller than a diameter of the through hole at the inner surface.

8. The housing as claimed in claim 7, wherein the through hole comprises two pillar spaces with different dimensions.

9. The housing as claimed in claim 7, wherein the through hole is a cone.

10. The housing as claimed in claim 7, wherein the diameter of the through hole at the outer surface is from 0.05 mm to 0.5 mm.

11. A handheld device comprising:

a host; and the housing as claimed in claim 1, wherein the housing encases the host.

12. A manufacturing method of a housing, comprising:

providing a body, wherein the body has a through hole, an outer surface and an inner surface opposite to the outer surface, and the through hole extends from the outer surface to the inner surface;

electroplating a metal antenna layer formed on the outer surface of the body, wherein the metal antenna layer covers the through hole, an edge of the metal antenna layer is connected to the outer surface, and a surface of the metal antenna layer is at least partially exposed by the body;

disposing a conductive element in the through hole and directly contacting the metal antenna layer, wherein the conductive element is adapted to transmit signals received by the metal antenna layer; and disposing a grounding pad on the inner surface of the body, wherein the grounding pad covers the through hole and directly contacts with the conductive element.

13. The manufacturing method of a housing as claimed in claim 12, wherein the step of forming a metal antenna layer by electroplating comprises:

activating a part of the outer surface of the body to form an activated region;

forming a plating seed layer in the activated region; and electroplating a plating metal layer formed on the plating seed layer, wherein the metal antenna layer comprises the plating seed layer and the plating metal layer.

14. The manufacturing method of a housing as claimed in claim 13, wherein when electroplating the plating metal layer, disposing a mask above the plating seed layer so as to shield an edge of the plating seed layer.

15. The manufacturing method of a housing as claimed in claim 14, wherein when the plating metal layer is electroplated, a distance between the mask at the edge of the plating seed layer and the plating seed layer is smaller than a distance between the mask away from the edge of the plating seed layer and the plating seed layer.

16. The manufacturing method of a housing as claimed in claim 12, wherein the grounding pad and the conductive element are integrally formed when the metal antenna layer is electroplated.

17. The manufacturing method of a housing as claimed in claim 12, wherein the step of forming a through hole comprises:

drilling the body from the inner surface to obtain a first pillar space; and drilling the body from a bottom surface of the first pillar space to obtain a second pillar space, wherein a dimension of the first pillar space is smaller than a dimension of the second pillar space.

18. The manufacturing method of a housing as claimed in claim 12, wherein the step of forming a through hole comprises drilling the body from the inner surface to obtain the through hole in a cone-shaped.

* * * * *